US006095143A

United States Patent [19]

Dyrud et al.

[11] Patent Number: 6,095,143

[45] **Date of Patent: *Aug. 1, 2000**

[54] FACE MASK HAVING A COMBINATION ADJUSTABLE EAR LOOP AND DROP DOWN BAND

[75] Inventors: James F. Dyrud, New Richmond, Wis.; Cynthia Y. Tamaki, Arden Hills, Minn.; Isao Kuniya, Sagamihara, Japan

[73] Assignee: Minnesota Mining and Manufacturing Company, St. Paul, Minn.

[ * ] Notice: This patent is subject to a terminal disclaimer.

[21] Appl. No.: 09/169,907

[22] Filed: Oct. 12, 1998

Related U.S. Application Data

[63] Continuation of application No. 08/778,936, Jan. 3, 1997, Pat. No. 5,819,731.

[51] Int. Cl.[7] ..... A62B 18/00

[52] U.S. Cl. ..... 128/206.27; 128/207.11; 128/206.13; 128/207.13; 2/9

[58] Field of Search ..... 128/206.27, 207.11, 128/207.13, 206.24, 206.21, 206.12, 206.13

[56] References Cited

U.S. PATENT DOCUMENTS

| | | | |
|---|---|---|---|
| 1,292,095 | 1/1919 | Schwartz . | |
| 1,292,096 | 1/1919 | Schwartz . | |
| 2,281,744 | 5/1942 | Brunner . | |
| 2,458,580 | 1/1949 | Fisketti et al. . | |
| 2,494,406 | 1/1950 | Reitano . | |
| 3,013,556 | 12/1961 | Galleher, Jr. . | |
| 3,620,214 | 11/1971 | Thackston . | |
| 3,878,563 | 4/1975 | Pulju | 2/9 |
| 3,884,227 | 5/1975 | Lutz et al. . | |
| 3,886,597 | 6/1975 | Dupre . | |
| 3,960,096 | 6/1976 | Zobel . | |
| 4,014,047 | 3/1977 | Zobel . | |
| 4,084,585 | 4/1978 | Venaleck . | |
| 4,195,629 | 4/1980 | Halford . | |
| 4,201,205 | 5/1980 | Bartholomew . | |
| 4,319,567 | 3/1982 | Magidson . | |
| 4,414,973 | 11/1983 | Matheson et al. . | |
| 4,536,440 | 8/1985 | Berg . | |
| 4,657,010 | 4/1987 | Wright . | |
| 4,790,307 | 12/1988 | Haber et al. . | |
| 4,802,473 | 2/1989 | Hubbard et al. . | |
| 4,807,619 | 2/1989 | Dyrud et al. . | |
| 4,941,470 | 7/1990 | Hubbard et al. . | |
| 5,007,114 | 4/1991 | Numano . | |
| 5,237,986 | 8/1993 | Seppala et al. . | |
| 5,349,949 | 9/1994 | Schegerin | 128/206.24 |
| 5,357,947 | 10/1994 | Adler . | |
| 5,431,158 | 7/1995 | Tirotta . | |
| 5,464,010 | 11/1995 | Byram . | |
| 5,553,608 | 9/1996 | Reese et al. . | |
| 5,590,646 | 1/1997 | Murphy . | |
| 5,655,527 | 8/1997 | Scarberry et al. | 128/206.24 |
| 5,819,731 | 10/1998 | Dyrud et al. . | |
| 6,019,101 | 2/2000 | Cotner et al. | 128/207.13 |

FOREIGN PATENT DOCUMENTS

| | | |
|---|---|---|
| 2134914 | 5/1995 | Canada . |
| 34-12900 | 8/1959 | Japan . |
| 5-110218 | 11/1993 | Japan . |
| 7-23266 | 7/1996 | Japan . |
| 668976 | 3/1952 | United Kingdom . |
| 893614 | 4/1962 | United Kingdom . |

*Primary Examiner*—John G. Weiss
*Assistant Examiner*—V. Srivastava
*Attorney, Agent, or Firm*—Karl G. Hanson

[57] ABSTRACT

A face mask (10) covers the nose and mouth of the wearer and includes a band (24) to retain the mask member (12) in position. The band attaches at the sides (20) of the mask and extends around the ears of the wearer and loops through orifices (32). The band (24) extends around the back of the neck and provides for retaining the mask (10) at the front of the wearer when not worn. Ends (26) of the band (24) are elastic to provide a snug fit for the mask (10).

18 Claims, 3 Drawing Sheets

FIG. 2
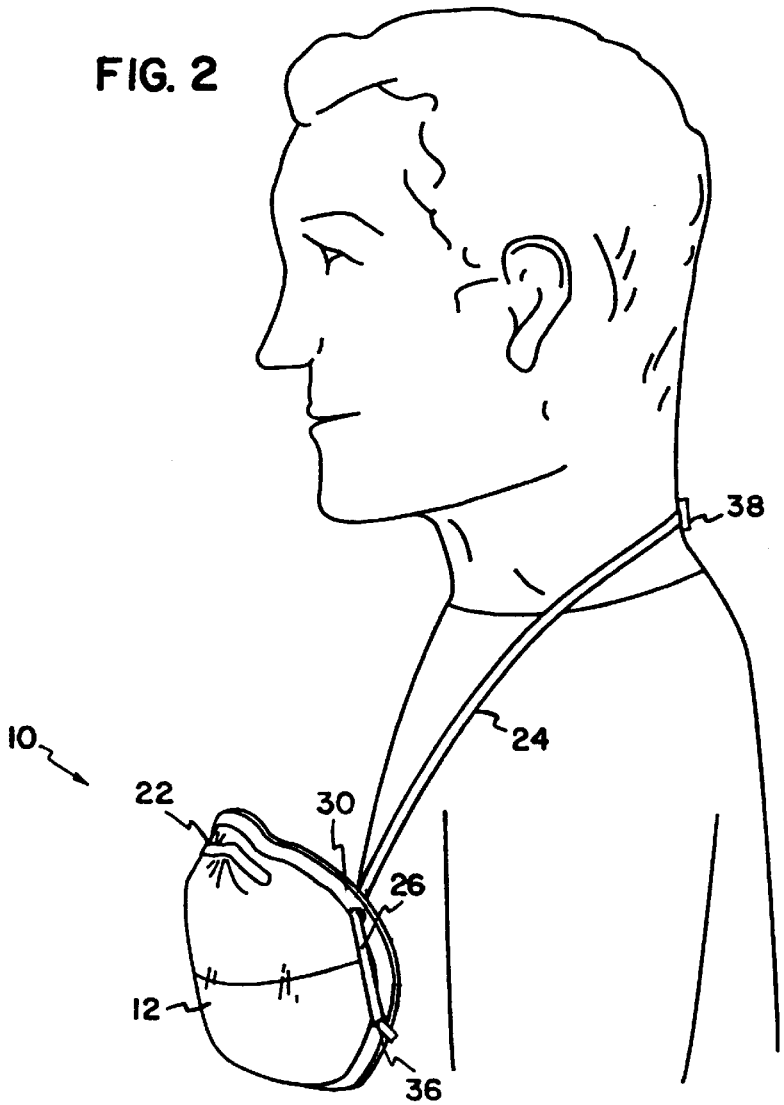
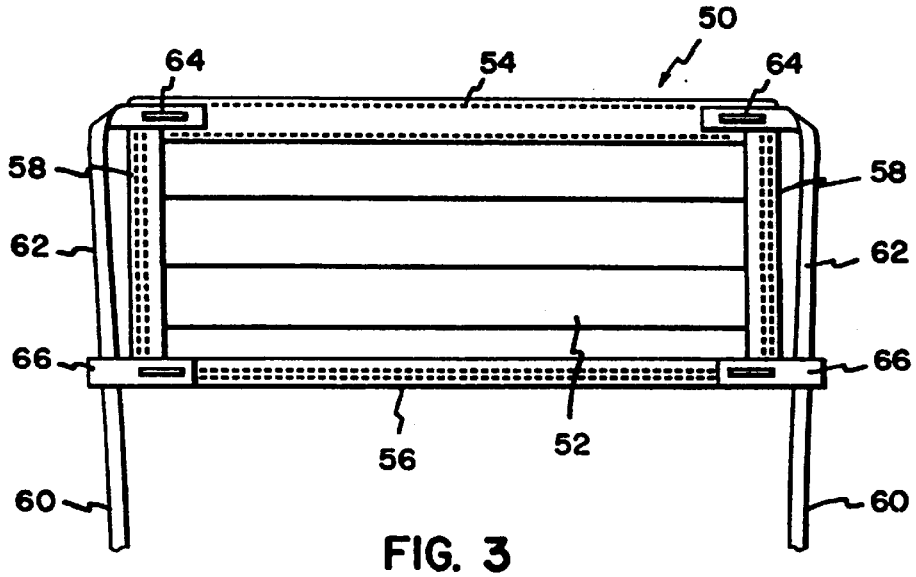
FIG. 3

FACE MASK HAVING A COMBINATION ADJUSTABLE EAR LOOP AND DROP DOWN BAND

This is a continuation of application Ser. No. 08/778,936 filed on Jan. 3, 1997 now U.S. Pat No. 5,819,731.

TECHNICAL FIELD

The present invention relates to a face mask having a band with ear loop attachments as well as drop down support for when the mask is not being worn.

BACKGROUND

Face masks that cover the nose and mouth of the wearer to filter air and/or prevent the spread of germs are well known. Masks take on many forms, including disposable molded masks that substantially fit the contour over the bridge of the nose and around the mouth of the wearer, and flexible masks used for surgery. Masks typically include one or more bands for attachment around the back of the head to retain the mask over the wearer's nose and mouth. Other masks provide for an ear loop attachment wherein bands extending from the side of the mask loop around the back of the wearer's ears.

There are advantages associated with providing a mask that attaches over the wearer's ears rather than looping around the back of the head. The mask may be easier to don and doff. In addition, bands which extend around the back of the wearer's head may be less appealing to many wearers because the bands may become entangled in the wearer's hair or otherwise ruin the wearer's hair style.

In addition to providing a mask that is retained by ear loops, it is also known to provide a drop down band on the mask. A drop down band allows the mask to be retained around the wearer's neck when the mask is not being worn over the nose and mouth. In this manner, the mask is retained at the wearer's chest and does not need to be stored. This provides for quickly accessing the mask to reposition over the wearer's nose and mouth. The drop down feature also frees the wearer's hands to perform other tasks. If a mask is inconvenient to don and doff or is not readily available and accessible when not worn, the wearer is less likely to put the mask on, creating health hazards.

Although masks are known which provide a drop down feature, and other masks are known which provide ear loop attachments, the art does not disclose a mask that provides both ear loop attachments as well as a drop down feature. U.S. Pat. No. 5,237,986 to Seppala et al., and U.S. Pat. No. 5,464,010 to Byram show masks that provide for a drop down band. None of the masks, however, provide ear loop attachments to the wearer. U.S. Pat. No. 2,281,744 to Brunner, U.S. Pat. No. 2,458,580 to Fisketti et al., and U.S. Pat. No. 1,292,096 to Schwartz each show a mask that provides an ear loop attachment, but none of these masks provide a drop down band.

It can then be seen that a new and improved mask is needed that provides both drop down retention as well as an ear loop attachment. Such a mask should provide for securely retaining the mask by attaching around the ears of the wearer with a single band. Moreover, a band should extend around the back of the wearer's neck and should retain the mask in an easily accessible location in front of the wearer when the mask is not being worn. The present invention addresses these as well as other problems associated with mask bands.

SUMMARY OF THE INVENTION

The present invention is directed to a face mask that covers the nose and mouth of the wearer and that has an ear loop support and a drop down band. Masks that cover the nose and mouth of the wearer and use a band for retaining the mask over the nose and mouth are well known. The masks may be molded, made of a flexible fabric, or use other configurations for fitting over the nose and mouth that require a retaining band. The present invention utilizes a band that is configured for extending around the ears of the wearer to support the mask against the wearer's face over the nose and mouth.

The band attaches at each side of the mask near either the upper or the lower portion. An orifice or other retainer guide that provides for slidably retaining the band is located at each side of the mask and in spaced apart relationship to an attachment point for each end of the band. The band may be continuous around the back of the neck or separate sections may tie or clip together. This configuration provides for four attachment points and comfortable and secure positioning of the mask against the face of the wearer. The band preferably includes an elastic end portion or may be entirely made of elastic material. The band fits around the back of the ears of the wearer to retain the mask in position and provides for adjusting to a variety of sizes. When not worn, the band extends around the back of the neck of the wearer and retains the mask in an accessible position at the front of the wearer.

BRIEF DESCRIPTION OF THE DRAWINGS

In the drawings, like numerals and letters designate corresponding structure throughout the several views:

FIG. 2 shows a perspective view of the mask shown in FIG. 1 having an alternate band mounting configuration dropped down and supported around the neck of a wearer;

FIG. 3 shows a front elevational view of a second embodiment of a mask according to the principles of the present invention;

DETAILED DESCRIPTION OF PREFERRED EMBODIMENT

Figure 1:
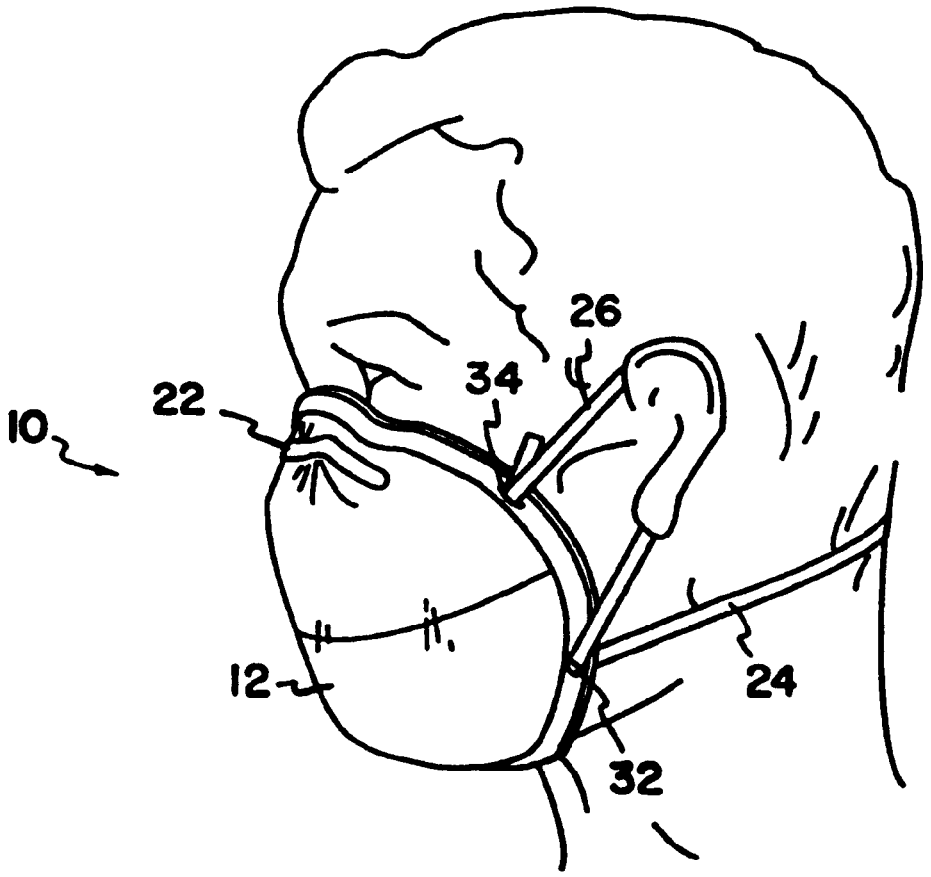
FIG. 1 shows a perspective view of a first embodiment of a mask according to the principles of the present invention being worn.

As shown in FIG. 1, a mask 10 includes a cup-like mask body 12 typically made of fibrous filter material and molded to fit over the mouth and nose of a wearer, generally following the contour of the wearer's face. The mask body 12 includes an upper portion 16 and a lower portion 18 as well as side portions 20, as shown more clearly in FIG. 4. A nose clip 22 is utilized to provide additional forming over the bridge of the wearer's nose. Fabric-type fibrous filtering material of the mask body 12 removes particulates from the air, providing a breathable air supply.

As shown in FIG. 1, a band 24 attaches at an upper point by means of staple or other fastener 34 and loops around the ear of the wearer. After looping around the ear, the band 24 extends to the front of the mask 10 through a lower orifice 32 or other band guide in the mask body 12 and extends around the back of the neck of the wearer. It can be appreciated that the band 24 should be sized for the wearer or may be adjustable or should include at least some elastic material to provide a snug fit. In the preferred embodiment, at least the end portions 26 extending between the upper fastener 34 and the lower orifice 32 have elasticity. This elasticity of the band 24 also provides sufficient flexibility to fit a range of head sizes.

Figure 4:
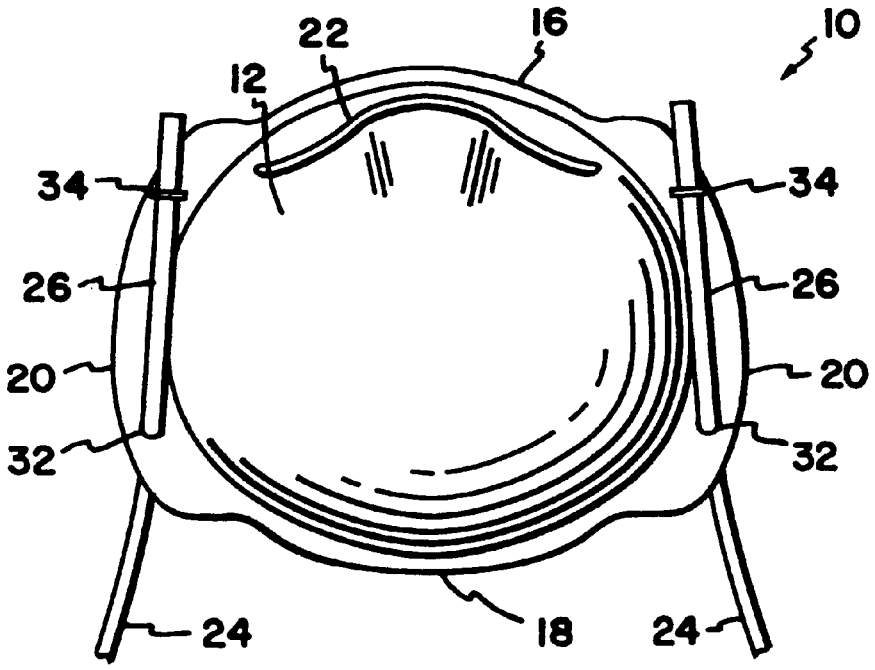
FIG. 4 shows a front elevational view of the mask shown in FIG. 1.
Figure 5:
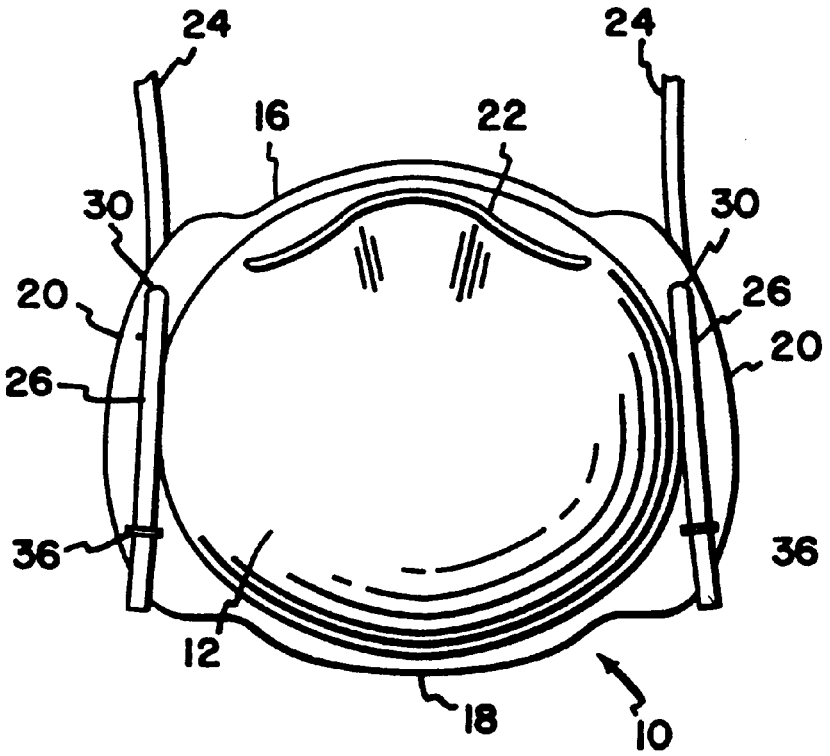
FIG. 5 shows a front elevational view of the mask shown in FIG. 2 having the alternate band mounting configuration.

As shown in FIGS. 4 and 5, it can be appreciated that there are multiple mounting configurations possible with the present invention that provide an ear loop attachment and a drop down band. In the embodiment shown in FIGS. 1 and 4, the band 24 is fixedly attached by staples 34 or other well known fastening devices at the sides 20 near the upper portion 16 of the mask body 12. The band 24 extends through the orifices 32 at the sides 20 spaced apart from the staples 34 and near the lower edge 18. The band 24 extends around the back of the neck of the wearer and the mask 10 as shown in FIG. 1. The band 24 may be a continuous element or have two sections that may be clipped, tied or otherwise releasably fastened around the back of the neck. The band may also have a slidable length adjustment.

Referring to FIGS. 2 and 5, the band 24 can also be mounted in a reversed orientation using fasteners such as staples 36 near the lower portion 18. Orifices 30 or other guides are positioned at the sides 20 near the upper portion 16 of the mask body 12 in spaced apart relationship to the lower fasteners 36. With this configuration, the band 24 fastens near the lower portion 18 and extends up through the orifices 30 near the upper portion 16. With this mounting configuration, the band 24 extends from the lower fastener 36 around the ears and through the upper orifice 30 when worn. When not worn over the nose and mouth, the band 24 extends around the neck of the wearer from the upper portion of the mask body 12 so that the drop down retention feature is maintained.

Referring now to FIG. 2, when not worn over the nose and mouth, the mask 10 is supported by the band 24 extending around the back of the neck of the wearer. The band 24 shown in FIG. 2 includes two sections joined by a clip or other fastener 38 at the back of the neck. The mask body 12 generally falls onto the chest of the wearer so that the mask 10 is retained, thereby freeing the hands of the wearer. Depending on the band configuration, the mask body 12 may also flip over on the wearer's chest with the upper portion 16 extending downward, rather, than the position shown in FIG. 2.

As explained above, it can be appreciated that the mounting configurations of the band 24 can also be used with other types of masks, such as surgical masks 50, shown in FIG. 3. The mask 50 includes a flexible mask body 52, typically made of a fabric, for covering the nose and mouth of the wearer. The mask body includes a top edge 54, a bottom edge 56, and sides 58. A band 60 extends from the upper corners of the mask body 52 and extends down through loops 66 at the sides 58 along the bottom edge 56. The band 60 includes an end elastic portion 62 in the preferred embodiment. It can be appreciated that the band 60 extends from attachment point 64 over the ears of the wearer when worn and then through the loop 66 and around the back of the neck of the wearer similar to the arrangement shown in FIG. 1. It can also be appreciated that the mask 50 can be reversed with the end attachment points 64 located along the bottom edge and the loops 66 positioned near the top of the mask 60 when worn. The ear loop and drop down configurations of the band 60 are similar to those shown in FIG. 1.

The band 24 can be sized for fitting specific individuals of a specific size. However, it can be appreciated that, with at least some elasticity in the end portions 26 or along the entire band 24, a single size band can accommodate a variety of sizes and fit most wearers. The band 24 may also use a clip 38 slidably connecting two band sections. It can also be appreciated that although the band 24 slides through the orifices 32, the pressure from the resistance placed upon the mask by stretching the band 24 around the ears of the wearer is sufficient to retain the mask 10 in the proper position when worn. However, when the pressure is released from around the back of the ears of the wearer, the band 24 is freed to slide through the orifices 32, as shown in FIG. 2. It can also be appreciated that the band 60 and loops 66 of the mask 50 shown in FIG. 3 provide similar sizing flexibility.

It is to be understood, however, that even though numerous characteristics and advantages of the present invention have been set forth in the foregoing description, together with details of the structure and function of the invention, the disclosure is illustrative only, and the changes may be made in detail, especially in matters of shape, size and arrangement of parts within the principles of the invention to the full extent indicated by the broad general meaning of the terms in which the appended claims are expressed.

What is claimed is:

1. A mask that comprises:

(a) a mask member that is configured to cover the nose and mouth of a wearer and that has side portions; and (b) at least one band for supporting the mask member over the wearer's nose and mouth;

wherein the at least one band is fixedly attached to the mask member at first locations on the opposed side portions and is slidably disposed at second locations in spaced apart relation to the first locations such that (i) sufficient band length can be drawn between the first and second locations so that the band can be placed over each of the wearer's ears when being worn and such that (ii) the band can extend behind the wearer's neck to enable the mask to be temporarily suspended therefrom in front of the wearer when not being worn.

2. The mask of claim 1, wherein the first and second locations are spaced vertically from each other when the mask is oriented as when being worn by a person.

3. The mask of claim 1, wherein the mask member is a cup-shaped body that is capable of filtering particulates from air that passes therethrough when the mask is in use.

4. The mask of claim 1, wherein the band is slidably disposed at the second locations by a band guide means.

5. The mask of claim 1, further comprising a staple that fixedly attaches the band to the mask member.

6. The mask of claim 1, wherein the mask member comprises a molded cup-type mask member.

7. The mask of claim 4, wherein the band guide means comprises orifices formed through the mask member.

8. The mask of claim 1, wherein the mask member comprises a substantially rectangular filtering element.

9. The mask of claim 8, wherein the band is disposed through a loop located at each side portion of the mask member.

10. The mask of claim 1, wherein the band includes an elastic portion proximate each first location.

11. The mask of claim 1, wherein the band further comprises a device that divides the band into two sections and that slidably connects the sections together.

12. The mask of claim 1, wherein the band comprises an elastic portion.

13. The mask of claim 1, wherein the band is attached proximate an upper portion of the mask member, and wherein the band is slidably disposed in orifices located proximate a lower portion of the mask member.

14. The mask of claim 1, wherein the band is fixedly attached at each side portion proximate a lower portion of the mask member, and wherein the band is slidably disposed in orifices located proximate an upper portion of the mask member.

15. The mask of claim 1, wherein the mask member has orifices formed therein that have the band slidably disposed therethrough at the second locations.

16. The mask of claim 1, wherein the band comprises an elastic portion and is adjustable.

17. The mask of claim 1, wherein the band includes two sections that can be joined together behind the wearer's neck.

18. The mask of claim 1, wherein the band when worn exerts pressure around the ears of the wearer sufficient to retain the mask in a proper position over the nose and mouth of the wearer when being worn.

* * * * *